US009099767B2

(12) United States Patent
Binkofski et al.

(10) Patent No.: US 9,099,767 B2
(45) Date of Patent: Aug. 4, 2015

(54) ANTENNA CORE, ANTENNA, AND METHODS FOR PRODUCING AN ANTENNA CORE AND AN ANTENNA

(76) Inventors: Johannes Binkofski, Rodenbach (DE); Markus Brunner, Bessenbach (DE); Klemens Trabold, Elsenfeld (DE); Ralf Koch, Freiensteinau (DE)

( * ) Notice: Subject to any disclaimer, the term of this patent is extended or adjusted under 35 U.S.C. 154(b) by 424 days.

(21) Appl. No.: 13/575,763

(22) PCT Filed: Jan. 28, 2011

(86) PCT No.: PCT/EP2011/051258

§ 371 (c)(1),
(2), (4) Date: Oct. 15, 2012

(87) PCT Pub. No.: WO2011/092309

PCT Pub. Date: Aug. 4, 2011

(65) Prior Publication Data

US 2013/0088401 A1 Apr. 11, 2013

(30) Foreign Application Priority Data

Jan. 29, 2010 (DE) ..... 10 2010 001 394

(51) Int. Cl.

| | |
|---|---|
| ***H01Q 1/00*** | (2006.01) |
| ***H01Q 7/08*** | (2006.01) |
| ***H01F 3/04*** | (2006.01) |
| ***H01F 41/02*** | (2006.01) |
| ***H01Q 1/22*** | (2006.01) |

(Continued)

(52) U.S. Cl.

CPC ..... *H01Q 7/08* (2013.01); *H01F 1/15333* (2013.01); *H01F 3/04* (2013.01); *H01F 41/0226* (2013.01); *H01F 41/0691* (2013.01); *H01Q 1/2216* (2013.01); *H01Q 7/06* (2013.01); *Y10T 29/49016* (2015.01)

(58) Field of Classification Search

CPC ..... H01Q 7/08; H01Q 7/06; H01Q 1/2216; H01F 41/0691

USPC ..... 343/787, 788, 713; 29/600

See application file for complete search history.

(56) References Cited

U.S. PATENT DOCUMENTS

| | | | | |
|---|---|---|---|---|
| 2006/0022886 | A1 * | 2/2006 | Hein et al. | 343/787 |
| 2006/0066498 | A1 * | 3/2006 | Abe et al. | 343/788 |

(Continued)

FOREIGN PATENT DOCUMENTS

| | | | |
|---|---|---|---|
| DE | 25 21 666 | A1 | 12/1975 |
| EP | 0695812 | A1 | 2/1996 |

(Continued)

OTHER PUBLICATIONS

First Office Action dated Dec. 23, 2013 in parallel Chinese Application No. 201180007619.

(Continued)

*Primary Examiner* — Hoanganh Le
(74) *Attorney, Agent, or Firm* — Dickinson Wright PLLC

(57) ABSTRACT

The invention relates to an antenna core, an antenna comprising an antenna core, and to methods for producing an antenna core and an antenna. The antenna core used in each case consists of a continuous soft-magnetic strip having a plurality of layers which are stacked one on top of the other and each of which is formed by a section of the strip. The layers are connected to one another by curved sections of the strip at end regions of the antenna core.

51 Claims, 4 Drawing Sheets

(51) Int. Cl.

| | |
|---|---|
| ***H01Q 7/06*** | (2006.01) |
| ***H01F 41/06*** | (2006.01) |
| ***H01F 1/153*** | (2006.01) |

(56) References Cited

U.S. PATENT DOCUMENTS

| | | | | |
|---|---|---|---|---|
| 2006/0214866 | A1 * | 9/2006 | Araki et al. | 343/788 |
| 2010/0084056 | A1 | 4/2010 | Ohta et al. | |
| 2011/0248819 | A1 * | 10/2011 | Saito et al. | 340/5.64 |

FOREIGN PATENT DOCUMENTS

| | | | |
|---|---|---|---|
| JP | 57-083005 | A | 5/1982 |
| JP | 2004147097 | | 5/2004 |
| JP | 2005184424 | | 7/2005 |
| JP | 2008-219305 | A | 9/2008 |
| WO | WO 2008/133302 | A1 | 11/2008 |

OTHER PUBLICATIONS

International Search Report (PCT/ISA/210) issued on Mar. 31, 2011, by the European Patent Office as the International Searching Authority for International Application No. PCT/EP2011/051258.

Written Opinion (PCT/ISA/237) issued on Mar. 31, 2011, by the European Patent Office as the International Searching Authority for International Application No. PCT/EP2011/051258.

Office Action for corresponding EP Application No. 11702603.9 Feb. 13, 2015.

* cited by examiner

ANTENNA CORE, ANTENNA, AND METHODS FOR PRODUCING AN ANTENNA CORE AND AN ANTENNA

BACKGROUND

1. Field

Disclosed herein are antenna cores and antennas, as they are used in recognition systems, e.g., in keyless entry systems. Such recognition systems can be used in the most varied technical applications. Locking systems in automotive applications, entry control systems for safety-relevant areas, etc., can be mentioned only by way of example.

2. Description of Related Art

The antenna cores or antennas are used as transmitting antennas for generating a magnetic field. The antennas are generally operated in a resonant oscillating circuit, which is tuned by matching a series capacitor and/or a series resistor to the impedance of the antenna arrangement at the desired transmitting frequency. In this case, antennas with the highest possible quality are usually used, which, however, requires a high expense for the tuning of the resonance circuit.

In the simplest case, such a transmitting antenna can be designed with a ferrite rod core of any cross-section. Due to the high isotropic volume resistance of this magnetic material alone, high quality and low magnetism reversal losses are achieved with no special additional measures.

It may be necessary, however, for the constructed space available for the accommodation of the antenna to limit the antenna cross-section and/or to require a bent or bendable antenna. Because of their poor elasticity and the material-typical low saturation induction, ferrite rods are therefore unsuitable.

SUMMARY

It remains desirable, therefore, to provide an antenna core and an antenna that are mechanically flexible. In addition, these antennas are to make possible a high enough degree of transfer efficiency or a high enough transmitting field strength with simultaneously simple tuning of the resonant oscillating circuit. These and other advantages are achieved by embodiments of an antenna core and antenna disclosed herein.

An antenna core according to one embodiment comprises several layers of a through magnetic strip and has an elongated shape. The magnetic strip has a soft-magnetic alloy, which has an amorphous or a nanocrystalline structure. The antenna core has two end areas that are some distance apart, in which curved sections of the strip are arranged. Each of the layers is connected in at least one of the two end areas by such a curved section to another of the layers, whereby the curved section is designed integrally with the two layers which it connects. If such an antenna core is arranged inside an electrical coil, a flexible antenna is produced. In one embodiment, the individual strip layers of the antenna core are not isolated from one another, but rather consist of electrically conductive compounds between the layers at the ends of the antenna core.

The production of an antenna core can be carried out, for example, such that a through strip that consists of a soft-magnetic alloy, which has an amorphous or a nanocrystalline structure, is wound into a winding body with multiple windings. The innermost of these windings has two sections that are opposite one another, which come to rest against one another after the flattening of the winding body. The layers of the antenna core are produced from the windings during flattening. By wrapping such an antenna core with a wire, an electrical coil is produced, in which the antenna core is arranged. The antenna core and the coil together form an antenna.

In comparison to the conventional rod antennas, as they are used in, e.g., keyless entry systems, such an antenna 30 shows lower quality and higher losses, which according to conventional wisdom are exactly what should be avoided in conventional systems. Surprisingly enough, however, it has been shown that in the typical, pulsed operating method of keyless entry systems, the low losses and high quality previously regarded as necessary in conventional systems are not required.

BRIEF DESCRIPTION OF THE DRAWINGS

Embodiments of the antenna core are explained by way of example below with reference to the attached figures. Here.

DETAILED DESCRIPTION OF SPECIFIC EMBODIMENTS

The detailed description below relates to the attached drawings in which based on specific configurations, it is explained in what way the invention can be carried out. Directional information used in this case, such as, e.g., "above", "below," "ahead," "behind," "front," "rear," etc., is used relative to the orientation of the figures that are explained. Since the elements in the configurations can be arranged in a number of various orientations, such direction-linked terminology is used only for descriptive explanation and is in no way understood to be limiting. It is pointed out that this invention can also be produced based on other, unexplained configurations with use of the explained principles. In addition, it is pointed out that the features of the various configurations that are described below by way of example can be combined with one another, if not expressly mentioned otherwise, or if not, the combination of specific features is ruled out for technical reasons.

Figure 1:
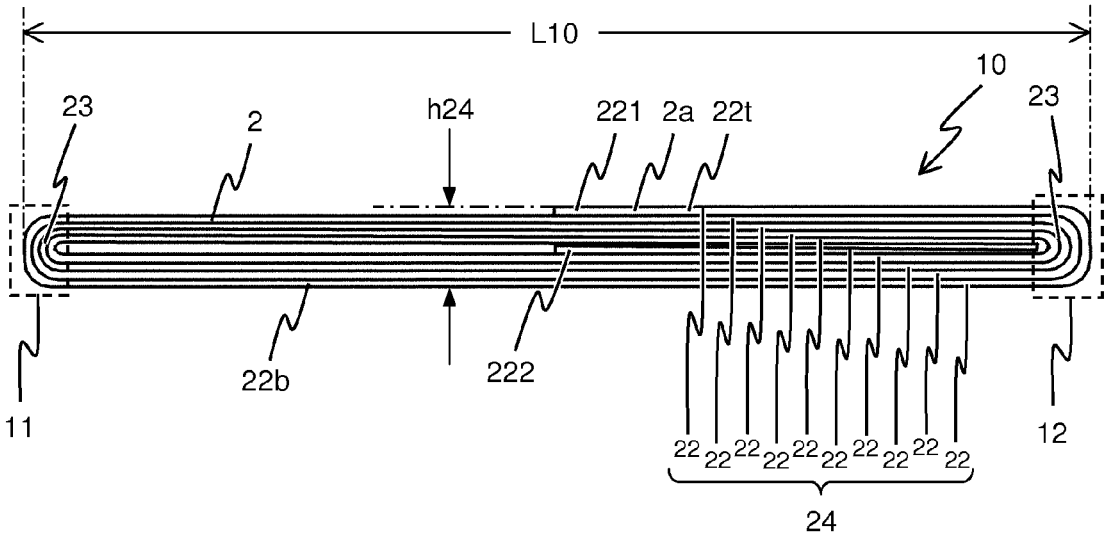
FIG. 1 is a schematic diagram that shows a side view of an antenna core that is wound from a magnetic strip.

FIG. 1 shows an antenna core 10, which has an elongated shape and which has a length L10 in its longitudinal direction. The antenna core 10 is produced from a long, flat strip 2 that consists of a soft-magnetic alloy, which has an amorphous or a nanocrystalline structure. The soft-magnetic alloy can be produced, for example, by means of a quick-setting method. The thickness of the strip 2 can be, for example, 10 μm to 30 μm.

The antenna core 10 comprises several layers 22 that are stacked to form a layer stack 24 and that in each case are formed by a section of the through strip 2. The use of several layers 22 leads to a high flexibility of the antenna core 10 in the direction in which the layers 22 are stacked. For this purpose, the antenna core 10 can also be inserted into, e.g., curved receiving areas. In the position of the antenna core 10 that is shown in FIG. 1, each of the layers 22 is essentially flat. The height h24, which the layer stack 24 has, is also referred to below as stack height h24. The stack height h24 is determined between two end areas 11 and 12 that are spaced some distance apart in the longitudinal direction of the antenna core 10, such that the stack height h24 is essentially equal to the product of the number of layers 22 of the layer stack 24 and the thickness d2 of the strip 2.

The end areas 11, 12 are characterized in that in each case, several curved sections 23 of the strip 2 are arranged on each other in them. Each of the layers 22 is connected at at least one of the end areas 11, 12 by one of the curved sections 23 to another layer 22. In this case, the curved section 23, which connects the two layers in question to one another, is designed integrally with the latter.

With the exception of the top layer 22*t* of the layer stack 24 and the bottom layer 22*b* of the layer stack 24, each of the layers 22 is arranged between two other layers 22 and at each of these two other layers 22 has a distance d22 that is smaller than the strip thickness of the soft-magnetic strip that is used for the production of the stack. Since adjacent layers 22 lie and generally rest directly on one another, the distance between them is normally equal to zero. Gas inclusions can also be located, however, between adjacent layers 22, e.g., from the gas of the atmosphere surrounding the antenna core 10, or inclusions from a solid body, which was introduced specifically between certain layers 22, e.g., to make it possible to fasten the antenna core so that adjacent layers 22 are locally spaced some distance apart. Such gas inclusions can be caused by, for example, an unavoidable waviness of the strip 2. Optionally, the possibility also exists in each case to isolate two adjacent layers 22 from one another specifically by a dielectric to avoid eddy current losses. Such a dielectric can be, for example, a film, or an oxide layer that is generated on the surface of the strip 2.

Figure 2:
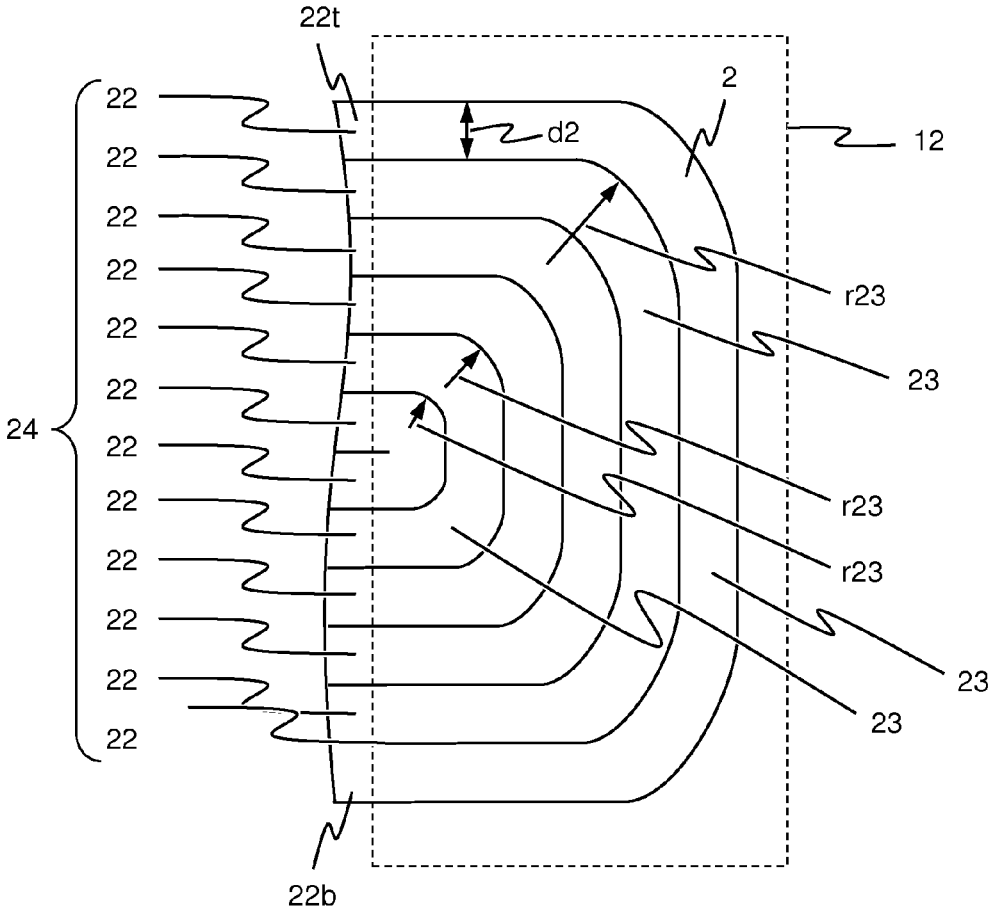
FIG. 2 is a schematic diagram that shows an enlarged cutaway of the view according to FIG. 1, which shows the right end area of the antenna core.

FIG. 2 shows an enlarged view of the right end of the antenna core 10 that is shown in FIG. 1 with the end area 12. The thickness of the strip 2 is referred to as d2. The curved sections 23 that are arranged in the end area 12 have a curvature radius r23 in each case at at least one point. In this case, the curvature radius r23 of at least one of the curved sections 23 can be smaller at at least one point than ten-times the strip thickness of the soft-magnetic strip that is used for the production. In addition, the curvature radius r23 of each of the curved sections 23 can be smaller in each case at at least one point than five-times the value produced from the stack height of the antenna rod.

Figure 3:
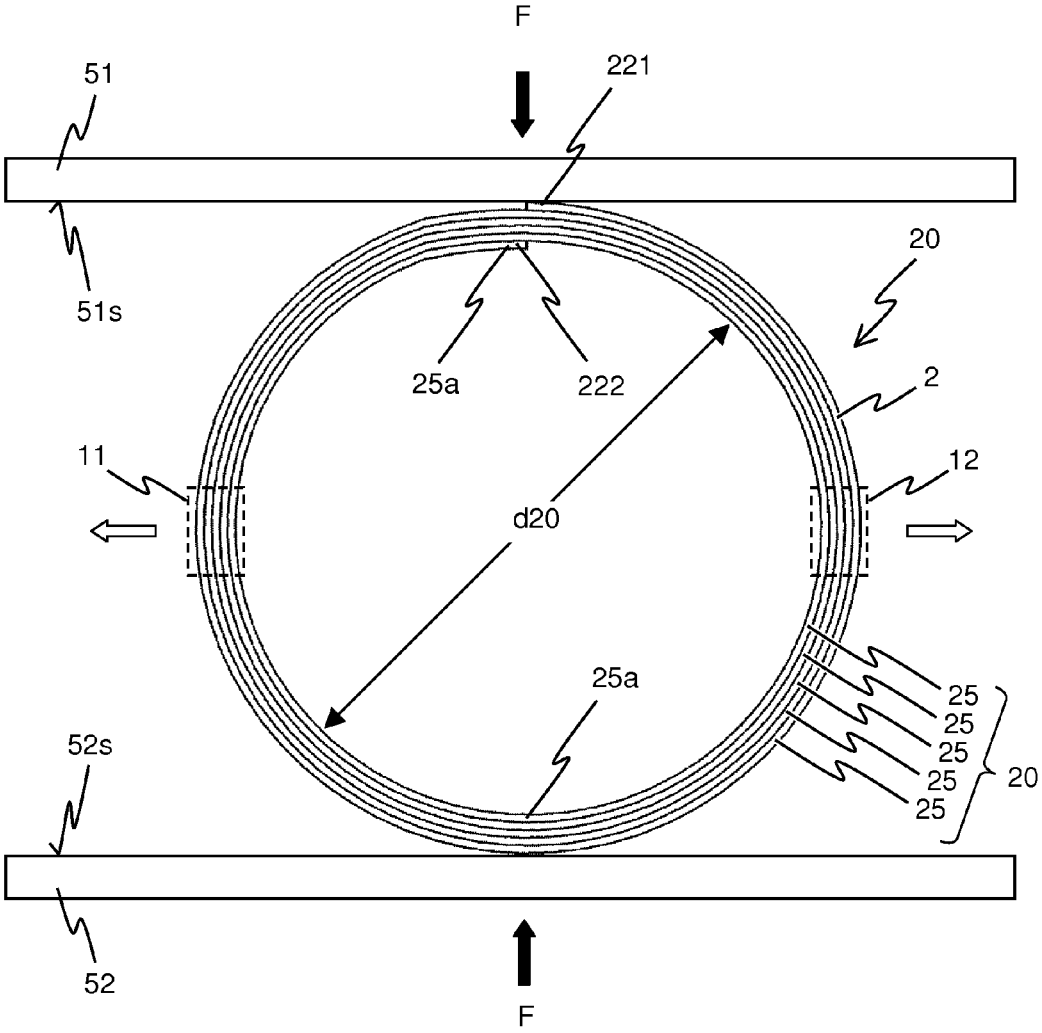
FIG. 3 is a schematic diagram that shows a winding body that consists of a magnetic strip, from which the antenna core that is shown in FIG. 1 is produced.

Below, a method for the production of such an antenna core 10 is explained by way of example in FIG. 3. From a flat soft-magnetic strip 2, first a winding body 20 is produced with a number of N25 windings 25 by the strip 2 being wound on a cylindrical or cylindrical-tubular section of a coil former (not shown). The inside diameter of the winding body 20 that is generated in this way is referred to as d20.

Then, the winding body 20 is removed from the coil former and clamped between plane-parallel sides 51*s*, 52*s* of two metal plates 51 and 52 and flattened under the action of a force F that acts on the metal plates 51, 52 in such a way that a longer rod is produced, which forms the antenna core 10 that is shown in FIG. 1. The subsequent end areas 11 and 12 are also shown in FIG. 3. The direction of movement of the end areas 11, 12 during the deformation of the winding body 20 is indicated in this case by the two open arrows.

The number N22 of the layers 22 of the finished antenna core 10 is in this case either equal to 2*N25 or equal to 2*N25+1, depending on where exactly the beginning 221 and the end 222 of the strip 2 come to rest.

Figure 4:
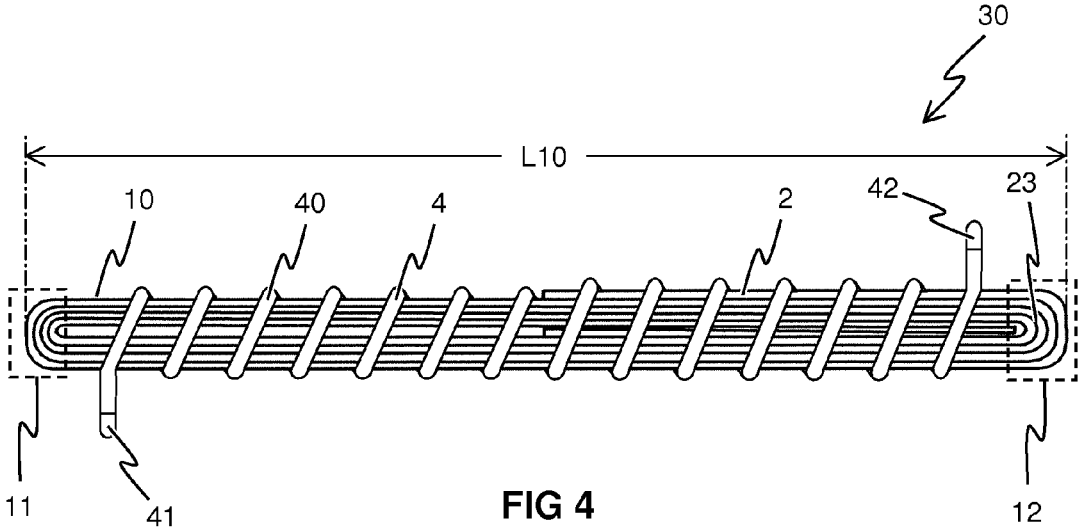
FIG. 4 is a schematic diagram that shows a side view of an antenna that is produced based on the antenna core according to FIG. 1.

An antenna 30, as it is shown by way of example in FIG. 4, is produced from such an antenna core 10 by the antenna core 10 being wound with a wire 4. The wire 4 then forms a coil 40, in which the antenna core 10 is arranged. The wire 4 can be, for example, a lacquer-coated wire, in which the lacquer at the ends 41, 42 of the coil 40 is removed to make possible an electrical contact of the coil 40 and thus the antenna 30.

Since the strip 2 for the production of the antenna core 10 does not have to be cut through, a very broad spectrum of alloys can be used for the material of the rod antenna. A limitation to the materials to those that allow the application of a sawing, cutting, punching or truncating technique is therefore unnecessary.

Below, based on three specific Examples 1, 2 and 3, it is explained how an antenna core 10 or an antenna 30 can be produced with the described method.

Example 1

In the simplest case, when the requirement for as small a magnetostriction as possible is eliminated, the strip 2 can consist of a soft-magnetic material, which in addition to typical contaminants of the commercially available raw materials or the melts essentially contains the alloy composition $$Fe_aX_bSi_cB_d$$

whereby a, b, c and d are indicated in at. %; and whereby the following applies: $0 \le b \le 45$; $6.5 \le c \le 18$; $4 \le d \le 14$; $c+d>16$; and $a+b+c+d=100$. In this case, X can consist of cobalt, or nickel, or a mixture of cobalt and nickel.

For the first specific example, a flat strip 2 with a width of 12 mm, a thickness d2 of 21 μm, and a nominal composition $FeSi_{12}B_9$ was used as strip 2. The winding number N25 of the windings 25 of the winding body 20 produced from this strip 2 was 15 with a diameter d20 of the winding body 20 of 75 mm. The number N22 of the layers 22 of the antenna core 10 that was produced after the deformation of the winding body 20 (see FIG. 1) was 31.

After the deformation, this antenna core 10 was subjected to a heat treatment in extremely pure hydrogen at a temperature of 450° C. for a period of 3 hours. The antenna core 10 obtained in connection to this heat treatment had a maximum material permeability of 31,000 and a remanence ratio Br/Bs>0.5. The remanence ratio indicates the ratio of remanence Br to the saturation induction Bs.

Figure 5:
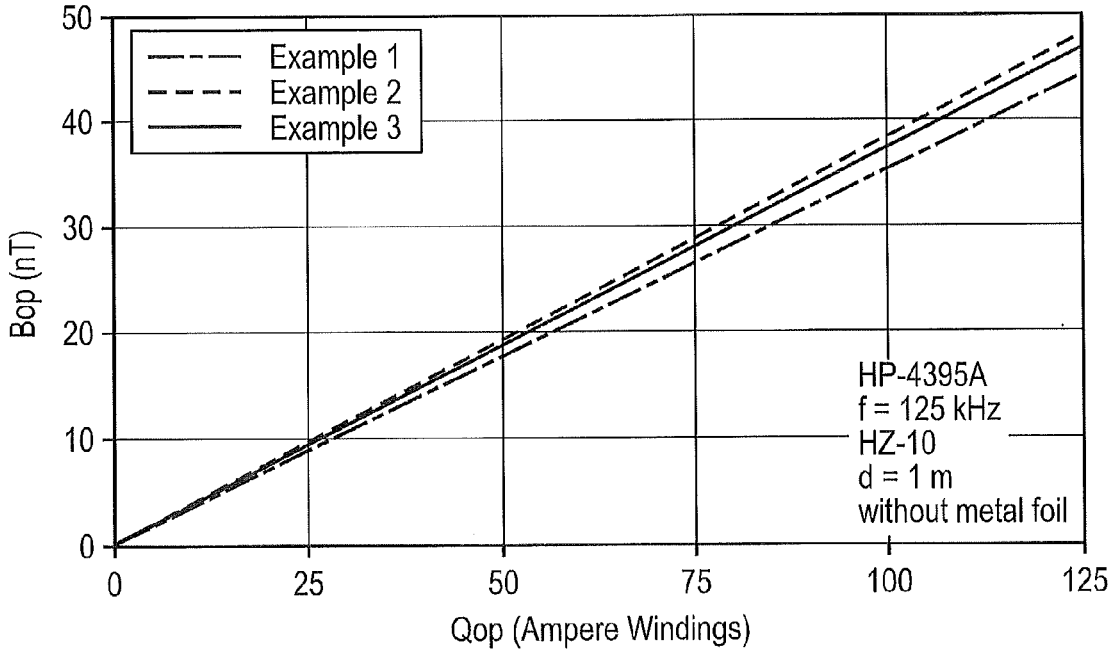
FIG. 5 is a graph that indicates the strength of the magnetic field for various alloy compositions of an antenna that is designed according to FIG. 4, a magnetic field that can be reached at a specific distance from the antenna under imposed boundary conditions.

With a rod antenna 30 that is formed from this antenna core 10 according to FIG. 4, field strengths of 35 nT were reached at a frequency of 125 kHz and a modulation of 100 ampere windings of the coil 40 at a distance of one meter from the antenna 30. FIG. 5 shows the dependency of the field strength reached at a distance of one meter from the antenna at a frequency of 125 kHz as a function of modulation. For Example 1 that is explained, the bottom curve in FIG. 5 is significant. In this example, the antenna quality at a frequency of 125 kHz is less than 28.

Example 2

Another embodiment is based on an alloy composition that, aside from typical contaminants of the commercially available raw materials or the melts, essentially has the composition $$Fe_aX_bCu_cSi_dB_eM_fZ_g.$$

In this case, M comprises at least one of the elements V, Nb, Ta, Ti, Mo, W, Zr and Hf. Z comprises at least one of the elements P, Ge and C. X can consist of cobalt, or nickel, or else a mixture of cobalt and nickel. The parameters a, b, c, d, e, f and g are indicated in at. % with $0 \leq b \leq 45$; $0.5 \leq c \leq 2$; $6.5 \leq d \leq 18$; $5 \leq e \leq 14$; $1 \leq f \leq 6$; $d+e>16$; $g<5$; and $a+b+c+d+e+f+g=100$.

For Example 2, the following specific nominal composition was selected for the material of strip 2:

$$FeCo_{0.5}Cu_{0.98}Nb_{2.28}Si_{15.7}B_{7.1}$$

The soft-magnetic strip 2 that is used had a width of 12.3 mm and a thickness d2 of 19.5 μm. The diameter d20 of the winding body 20 was in turn 75 mm with a number N25 of 20 windings.

After the deformation of the winding body 20 to form a flat, elongated antenna core 10 (FIG. 1), a heat treatment in extremely pure hydrogen was performed at the antenna core 10. In this case, to obtain a nanocrystalline volume proportion of more than 50%, it is necessary to allow the antenna core 10 to mature in a temperature range of 480° C. to 600° C. In this production step, the originally very high magnetostriction of approximately +25 ppm or more is simultaneously reduced to values of considerably less than +10 ppm.

Specifically, in this Example 2, a one-hour maturation at a temperature of 558° C. was selected. In this connection, a magnetostriction $\lambda_s$ in the range of 0 ppm to 0.2 ppm and simultaneously a maximum permeability of 285,000 as well as a remanence ratio Br/Bs>0.5 were set in the antenna core 10.

With the rod antenna 30 (FIG. 4) produced from this antenna core 10 by winding with a wire 4, field strengths of 48 nT were reached at a frequency of 125 kHz and a modulation of 125 ampere windings at a distance of one meter. The antenna quality at this frequency was less than 30. The top curve in FIG. 5 shows the dependency of the field strengths reached in turn at a distance of one meter from the antenna 30 at a frequency of 125 kHz on modulation.

Example 3

In another embodiment of the invention, an alloy that has the following composition is used as a magnetic material:

$$Co_a(Fe_{1-x}Mn_x)_bNi_cX_dSi_eB_fC_g$$

whereby X is at least one of the elements from the group V, Nb, Ta, Cr, Mo, W Ge and P. The parameters a, b, c, d, e, f, and g are indicated in at. %. They meet the following conditions: $40<a<82$; $2<b<10$; $0<c<30$; $0<d<5$; $0<e<15$; $7<f<26$; $0<g<3$; $15<d+e+f+g<30$; as well as $0<x<1$.

As a specific composition for Example 3, a strip 2 with the nominal composition $CoFe_{4.7}Si_{5.6}B_{17.2}$ was selected. The width of the strip 2 was 10 mm; its thickness d2 was 20.5 μm. The number N25 of the windings 25 of the winding body 20 was 20; the number N22 of the layers 22 of the antenna core 10 was 41. The inside diameter d20 of the winding body 20 was in turn 75 mm.

The winding body 20 (FIG. 3) was first subjected for a period of 4 hours to a heat treatment at a temperature of 365° C. During the heat treatment in the heat treatment space, a magnetic d.c. field was generated by means of a magnetizing coil that surrounds the heat treatment space. The orientation of the d.c. field was parallel to the winding axis of the winding body 20, i.e., perpendicular to the plane of projection relative to FIG. 3. In this connection, the magnetic material of the winding body 20 was magnetized until magnetic saturation took place.

The winding body 20 that was magnetized in this way was then deformed as described to form an elongated antenna core 10 according to FIG. 1, and in this state, it was inserted into an injection-molding housing produced from polyamide to stabilize the desired form of the antenna core 10. The finished antenna core 10 had a maximum material permeability of 1,600 and a remanence ratio Br/Bs<0.3.

With a rod antenna, produced from this antenna core 10, according to FIG. 4, field strengths of 45 nT were reached at a frequency of 125 kHz and a modulation of 120 ampere windings at a distance of one meter. The antenna quality at this frequency was <32. The mean curve in FIG. 5 shows in turn the course of the field strengths reached at a distance of one meter from the antenna 30 at a frequency of 125 kHz as a function of modulation.

Figure 6:
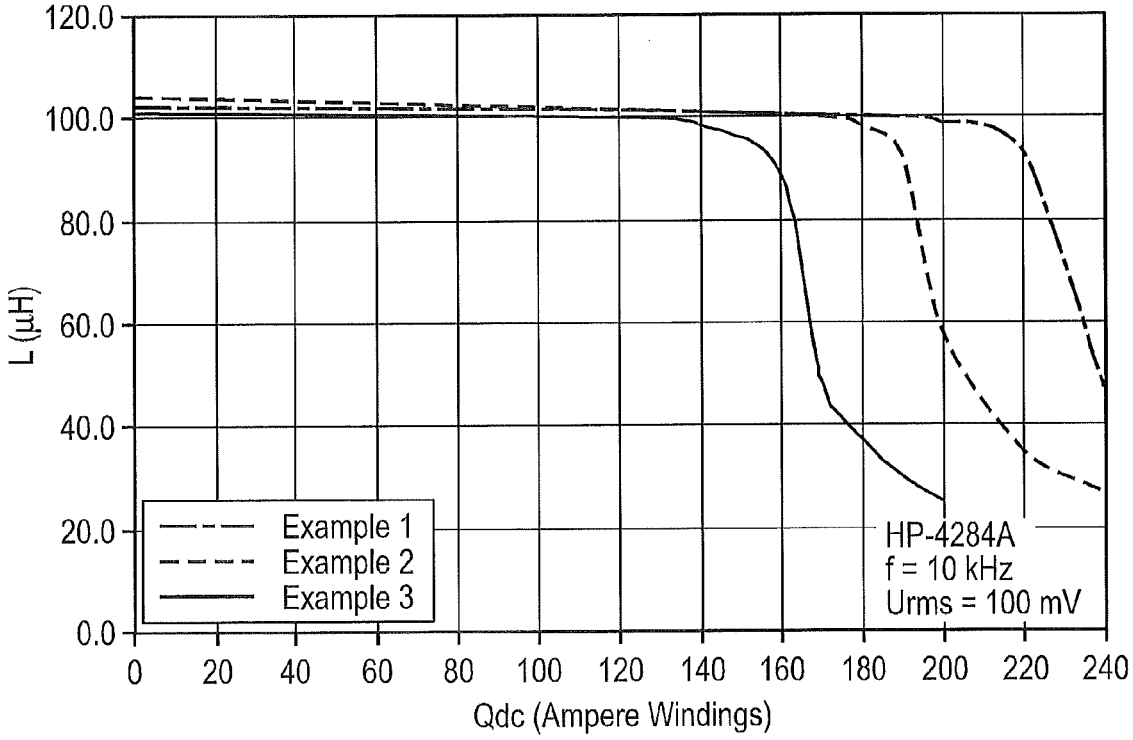
FIG. 6 is a graph that shows saturation behavior for various alloy compositions of an antenna core that is designed according to FIG. 1.

Finally, FIG. 6 also shows the saturation behavior for each of the three antennas 10 explained in Examples 1, 2 and 3. Inductivity is plotted as a function of coil current.

Figure 7:
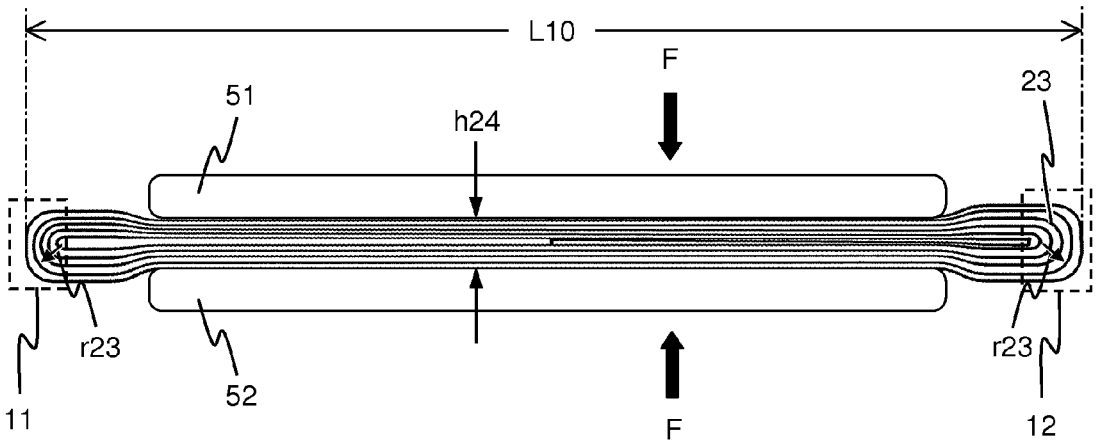
FIG. 7 is a schematic diagram that shows an antenna core corresponding to FIG. 1 during flattening, whereby the metal plates 51 or 52 that are used for flattening are shorter than the length of the flattened antenna core.

According to another configuration, the flattening for the production of an antenna core 10 can be carried out with use of metal plates 51, 52, whose length is smaller than the length L10 of the flattened antenna core 10, which is shown in FIG. 7. In this respect, it is ensured that the flattening of the antenna core 10 is carried out only between its end areas 11 and 12, but outside of the latter. Thus, after the flattening, the antenna core 10 has a constriction. In this respect, excessive stress of the end areas 11, 12 during flattening and thus a breaking of the strip 2 in the end areas 11 and 12 can be avoided. In such an antenna core 10, at least one of the curved sections 23 can have a curvature radius r23, which is smaller than five-times, or smaller than two-times, or smaller than one-time the stack height h24 of the strip (2).

Figure 8:
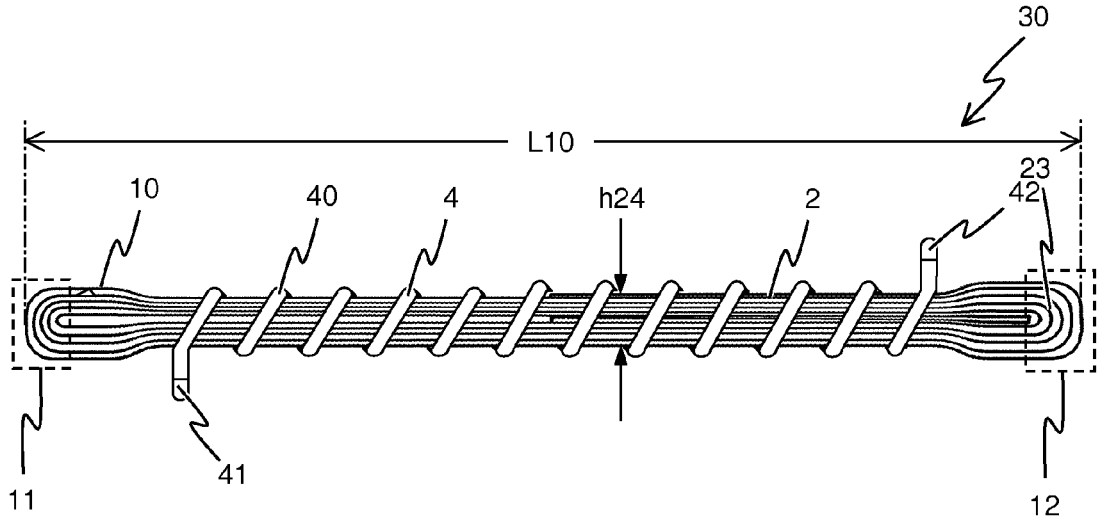
FIG. 8 is a schematic diagram that shows a side view of an antenna that is produced based on the antenna core according to FIG. 7.

FIG. 8 shows a finished antenna 30, by an antenna core 10 according to FIG. 7 having been wound with a wire 4, as was explained based on the antenna 30 shown in FIG. 4. The winding in this case can be carried out in such a way that the coil 40 is arranged only in the constricted section of the antenna core 10.

As was illustrated based on the preceding examples, a transmitting antenna can be produced with the proposed design of a rod antenna based on magnetic materials, which have very different properties with respect to maximum permeability and magnetostriction, which transmitting antennas can be produced extraordinarily economically and efficiently because of the small number and the simplicity of the necessary processing steps. The magnetism reversal losses that are increased by the metal-conductive connection at the ends 11, 12 of the antenna rod 30 do not represent a disadvantage in applications that are operated in a pulsed manner. Rather, it was observed that the tuning of the circuit during operation of the antenna 30 in a resonant control circuit is facilitated by the increased antenna impedance and that a broader frequency band is available because of the reduced antenna quality.

By means of an antenna 30, as it was described and explained in detail based on Examples 1 to 3, e.g., an above-mentioned keyless entry system or any other communication system can be produced in which a first communication partner and a second communication partner communicate with one another.

To this end, by means of a transmitting antenna that is designed according to a previously described antenna 30 and that is a component of the first communication partner, a magnetic field is generated in a preset frequency range, for example 9 kHz to 300 kHz, which is detected at a distance of a few meters by a receiving antenna, which is a component of the second communication partner. By the receiving of the magnetic field, communication between the first communication partner and the second communication partner is triggered in another frequency range, which can lie, for example, in the megahertz range. For communication in the other frequency range, the communication partners in each case can have another antenna, which is tuned to the other frequency range.

The antenna that is described in this application thus primarily has the object of generating a magnetic field in the kHz range. This offers essential streamlining and cost-saving measures in the production of the antenna and in the selection of magnetic materials that can be used in this respect. When energy is to be saved, savings are necessary or desirable the antenna can be operated not only continuously, but alternatively also pulsed.

Another advantage of the invention may result if the antenna with an antenna core that is designed according to this invention is operated in mobile applications. In conventional keyless entry systems primarily in automotive applications, it is common, for example, to use several short ferrite antennas in a motor vehicle to adequately cover the entire spatial area around the motor vehicle. Typically, the ferrite cores of these short antennas in each case have a length in the range of approximately 8 cm. Larger antennas with significantly longer ferrite cores are problematic primarily in mobile applications because of their high fragility. If, instead of this, antennas with antenna cores according to this invention are used within a motor vehicle, the latter can have considerably greater lengths in comparison to the above-mentioned ferrite cores. In this respect, in particular the transmission power of the individual antennas can be increased and thus correspondingly the number of antennas of a motor vehicle that is necessary for sufficient spatial coverage can be reduced. Thus, the length L3 of an antenna core 10 according to this invention, for example, can also be selected greater than or equal to 150 mm or greater than or equal to 200 mm. In principle, even greater lengths L3 of up to 500 mm or more than 500 mm are also possible. However, shorter antenna cores 10 with lengths of less than 150 mm can also be produced. Regardless of their length L3, antennas 30 or antenna cores 10 according to this invention can be used not only in automotive or mobile applications, but also in stationary operation.

The invention has been described with reference to certain specific examples and embodiments, which are intended to illustrate, but not limit, the scope of the appended claims.

The invention claimed is:

1. An antenna core, comprising:

an elongated shape having a plurality of layers of a through strip comprising a soft-magnetic alloy with an amorphous or nanocrystalline structure two end areas disposed a distance apart at either end of the elongated shape, comprising curved sections of the through strip, wherein each of the plurality of layers is connected in at least one of the end areas by a curved section of the through strip to another of the plurality of layers, wherein the curved section connecting these two layers is integral with these two layers, and wherein the through strip contains or consists of an alloy having the composition $$Fe_aX_bSi_cB_d$$

wherein a, b, c and d are indicated in at. %; wherein X consists of cobalt, or nickel, or a mixture of cobalt and nickel, and wherein the following applies: $0 \le b \le 45$; $6.5 \le c \le 18$; $4 \le d \le 14$; $c+d>16$, and $a+b+c+d=100$, and typical contaminants.

2. The antenna core according to claim 1, wherein the plurality of layers form a layer stack, wherein, except for a top layer of the plurality of layers and except for a bottom layer of the plurality of layers, each of the plurality of layers is arranged between two other layers of the plurality of layers, and wherein a distance between a layer and each of these two other layers is smaller than a thickness (d2) of the through strip.

3. The antenna core according to claim 1, wherein at least one of the curved sections has a curvature radius (r23) that is smaller than ten-times a thickness (d2) of the through strip.

4. The antenna core according to claim 3, wherein at least one of the curved sections has a curvature radius (r23) that is smaller than five-times a thickness (d2) of the through strip.

5. The antenna core according to claim 1, wherein each of the curved sections has a curvature radius (r23) that is smaller than five-times a stack height (h24) of the through strip.

6. The antenna core according to claim 5, wherein each of the curved sections has a curvature radius (r23) that is smaller than two-times the stack height (h24) of the through strip.

7. The antenna core according to claim 6, wherein each of the curved sections has a curvature radius (r23) that is smaller than the stack height (h24) of the through strip.

8. The antenna core according to claim 1, wherein the through strip has a thickness of 10 μm to 30 μm.

9. The antenna core according to claim 1, further comprising a constriction between the two end areas.

10. The antenna core according to claim 1, having a length of at least 150 mm or at least 200 mm.

11. A method for the production of an antenna core according to claim 1 comprising:

preparing a through strip, comprising a soft-magnetic alloy with an amorphous or nanocrystalline structure;

winding the through strip to form a winding body with multiple windings, including an innermost winding having two sections of the through strip that are opposite one another;

flattening the winding body, so that the two sections of the innermost winding come to rest against one another.

12. The method according to claim 11, wherein flattening the winding body comprises reducing the distance between the two sections of the innermost winding is smaller than the thickness (d2) of the through strip.

13. The method according to claim 11, wherein flattening the winding body is carried out by means of two metal plates, whose length is smaller than the length (L10) of the antenna core after flattening such that the finished antenna core is constricted between two end areas.

14. The method according to claim 11, further comprising heat treating the winding body before and/or after flattening in a temperature range of 350° C. to 600° C.

15. A method for the production of an antenna comprising:

preparing an antenna core, according to claim 11;

wrapping the antenna core with a wire to product an electrical coil.

16. An antenna comprising an antenna core according to claim 1, and an electrical coil, in which the antenna core is arranged.

17. The antenna according to claim 16, whose quality is less than 32.

18. An antenna core, comprising:

an elongated shape having a plurality of layers of a through strip comprising a soft-magnetic alloy with an amorphous or nanocrystalline structure two end areas disposed a distance apart at either end of the elongated shape, comprising curved sections of the through strip, wherein each of the plurality of layers is connected in at least one of the end areas by a curved section of the through strip to another of the plurality of layers, wherein the curved section connecting these two layers is integral with these two layers, and wherein the through strip contains or consists of an alloy having the composition $$Fe_aX_bCu_cSi_dB_eM_fZ_g$$

wherein M is at least one of the elements V, Nb, Ta, Ti, Mo, W, Zr and Hf; wherein Z is at least one of the elements P, Ge and C; wherein X is cobalt, or nickel, or else a mixture of cobalt and nickel; wherein a, b, c, d, e, f and g are indicated in at. %; and wherein the following applies: $0 \le b \le 45$; $0.5 \le c \le 2$; $6.5 \le d \le 18$; $5 \le e \le 14$; $1 \le f \le 6$; $d+e>16$; $g<5$; and $a+b+c+d+e+f+g=100$, and typical contaminants.

19. The antenna core according to claim 18, wherein the plurality of layers form a layer stack, wherein, except for a top layer of the plurality of layers and except for a bottom layer of the plurality of layers, each of the plurality of layers is arranged between two other layers of the plurality of layers, and wherein a distance between a layer and each of these two other layers is smaller than a thickness (d2) of the through strip.

20. The antenna core according to claim 18, wherein at least one of the curved sections has a curvature radius (r23) that is smaller than ten-times a thickness (d2) of the through strip.

21. The antenna core according to claim 20, wherein at least one of the curved sections has a curvature radius (r23) that is smaller than five-times a thickness (d2) of the through strip.

22. The antenna core according to claim 18, wherein each of the curved sections has a curvature radius (r23) that is smaller than five-times a stack height (h24) of the through strip.

23. The antenna core according to claim 22, wherein each of the curved sections has a curvature radius (r23) that is smaller than two-times the stack height (h24) of the through strip.

24. The antenna core according to claim 23, wherein each of the curved sections has a curvature radius (r23) that is smaller than the stack height (h24) of the through strip.

25. The antenna core according to claim 18, wherein the through strip has a thickness of 10 μm to 30 μm.

26. The antenna core according to claim 18, further comprising a constriction between the two end areas.

27. The antenna core according to claim 18, having a length of at least 150 mm or at least 200 mm.

28. A method for the production of an antenna core according to claim 18 comprising:

preparing a through strip, comprising a soft-magnetic alloy with an amorphous or nanocrystalline structure;

winding the through strip to form a winding body with multiple windings, including an innermost winding having two sections of the through strip that are opposite one another;

flattening the winding body, so that the two sections of the innermost winding come to rest against one another.

29. The method according to claim 28, wherein flattening the winding body comprises reducing the distance between the two sections of the innermost winding is smaller than the thickness (d2) of the through strip.

30. The method according to claim 28, wherein flattening the winding body is carried out by means of two metal plates, whose length is smaller than the length (L10) of the antenna core after flattening such that the finished antenna core is constricted between two end areas.

31. The method according to claim 28, further comprising heat treating the winding body before and/or after flattening in a temperature range of 350° C. to 600° C.

32. A method for the production of an antenna comprising:

preparing an antenna core, according to claim 28;

wrapping the antenna core with a wire to product an electrical coil.

33. An antenna comprising an antenna core according to claim 18, and an electrical coil, in which the antenna core is arranged.

34. The antenna according to claim 33, whose quality is less than 32.

35. An antenna core, comprising:

an elongated shape having plurality of layers of a through strip comprising a soft-magnetic alloy with an amorphous or nanocrystalline structure two end areas disposed a distance apart at either end of the elongated shape, comprising curved sections of the through strip, wherein each of the plurality of layers is connected in at least one of the end areas by a curved section of the through strip to another of the plurality of layers, wherein the curved section connecting these two layers is integral with these two layers, and wherein the through strip contains or consists of an alloy having the composition $$Co_a(Fe_{1-x}Mn_x)_bNi_cX_dSi_eB_fC_g$$

wherein X comprises at least one of the elements from the group V, Nb, Ta, Cr, Mo, W Ge and P, and wherein a, b, c, d, e, f, and g are indicated in at. %; and wherein the following applies: $40<a<82$; $2<b<10$; $0<c<30$; $0<d<5$; $0<e<15$; $7<f<26$; $0<g<3$; $15<d+e+f+g<30$; and $0<x<1$, and typical contaminants.

36. The antenna core according to claim 35, wherein the plurality of layers form a layer stack, wherein, except for a top layer of the plurality of layers and except for a bottom layer of the plurality of layers, each of the plurality of layers is arranged between two other layers of the plurality of layers, and wherein a distance between a layer and each of these two other layers is smaller than a thickness (d2) of the through strip.

37. The antenna core according to claim 35, wherein at least one of the curved sections has a curvature radius (r23) that is smaller than ten-times a thickness (d2) of the through strip.

38. The antenna core according to claim 37, wherein at least one of the curved sections has a curvature radius (r23) that is smaller than five-times a thickness (d2) of the through strip.

39. The antenna core according to claim 35, wherein each of the curved sections has a curvature radius (r23) that is smaller than five-times a stack height (h24) of the through strip.

40. The antenna core according to claim 39, wherein each of the curved sections has a curvature radius (r23) that is smaller than two-times the stack height (h24) of the through strip.

41. The antenna core according to claim 40, wherein each of the curved sections has a curvature radius (r23) that is smaller than the stack height (h24) of the through strip.

42. The antenna core according to claim 35, wherein the through strip has a thickness of 10 μm to 30 μm.

43. The antenna core according to claim 35, further comprising a constriction between the two end areas.

44. The antenna core according to claim 35, having a length of at least 150 mm or at least 200 mm.

45. A method for the production of an antenna core according to claim 35 comprising:

preparing a through strip, comprising a soft-magnetic alloy with an amorphous or nanocrystalline structure;

winding the through strip to form a winding body with multiple windings, including an innermost winding having two sections of the through strip that are opposite one another;

flattening the winding body, so that the two sections of the innermost winding come to rest against one another.

46. The method according to claim 45, wherein flattening the winding body comprises reducing the distance between the two sections of the innermost winding is smaller than the thickness (d2) of the through strip.

47. The method according to claim 45, wherein flattening the winding body is carried out by means of two metal plates, whose length is smaller than the length (L10) of the antenna core after flattening such that the finished antenna core is constricted between two end areas.

48. The method according to claim 45, further comprising heat treating the winding body before and/or after flattening in a temperature range of 350° C. to 600° C.

49. A method for the production of an antenna comprising:

preparing an antenna core, according to claim 45;

wrapping the antenna core with a wire to product an electrical coil.

50. An antenna comprising an antenna core according to claim 35, and an electrical coil, in which the antenna core is arranged.

51. The antenna according to claim 50, whose quality is less than 32.

* * * * *